United States Patent [19]

Webb, Sr.

[11] 4,019,763

[45] Apr. 26, 1977

[54] SAFETY LOCKING MECHANISM

[75] Inventor: William David Webb, Sr., Huntington, Conn.

[73] Assignee: E. I. Du Pont de Nemours and Company, Wilmington, Del.

[22] Filed: Jan. 21, 1976

[21] Appl. No.: 651,116

[52] U.S. Cl. ..... 292/207; 70/263; 70/282; 292/144

[51] Int. Cl.[2] ..... E05C 3/06; E05C 13/04

[58] Field of Search ..... 70/275–283, 70/262–265; 292/144, 201, 207; 57/76; 200/80 R; 340/264, 271, 419

[56] References Cited

UNITED STATES PATENTS

| | | | |
|---|---|---|---|
| 755,897 | 3/1904 | Lombardi | 70/277 |
| 1,361,317 | 12/1920 | Dulczewski et al. | 292/144 |
| 1,774,636 | 9/1930 | Cook | 70/283 |
| 2,237,192 | 4/1944 | Minkow et al. | 292/144 |

*Primary Examiner*—Paul R. Gilliam
*Assistant Examiner*—Kenneth J. Dorner

[57] ABSTRACT

A safety lock for a centrifuge prevents the opening of the rotor housing if the rotor is in operation and conversely prevents the rotor from being operated if the rotor housing is not latched and locked. A plunger linked to a cam follower is used to lock a door latch and to sense its latched or unlatched condition. The position of the cam follower and hence of the plunger is sensed by plural switches. The cam follower is biased by a spring to normally urge the plunger into a locking position with the latch. A drive cam, actuated under the control of the plural switches, withdraws the plunger to unlock the latch and releases the cam follower to permit the plunger to snap into a locking position.

13 Claims, 4 Drawing Figures

SAFETY LOCKING MECHANISM

BACKGROUND OF THE INVENTION

This invention relates to a safety locking mechanism and, more particularly, to a locking mechanism for a closure assembly in which the condition of the locking mechanism is sensed to control a hazardous operation housed in the closure assembly.

One of the recurring problems in product safety is the need for a safety lock for the door of an enclosure which houses an apparatus or machine whose operation or nature can be hazardous. In the case of a centrifuge, for example, the rotor must be housed within an enclosure so that if one of the swinging buckets or portion of the rotor itself comes loose by breaking or otherwise, it is prevented from flying out under the influence of centrifugal force into the surrounding region possibly injuring or killing any nearby person or persons. Similar safety locks are needed to insure that dangerous chemical processes or areas of high voltages are properly shielded when in operation.

When applied to a centrifuge rotor, the safety locking mechanism must insure firstly that the rotor cannot be started unless the enclosure door or lid is closed and latched. Hence, not only must the closure of the door be sensed, but its latched condition must also be sensed. Conversely, while the rotor is running, opening of the door must be prevented until such time as the rotor slows virtually to a stop. While many mechanisms have been devised over the years to provide appropriate interlocks and safety latching and locking mechanisms, most of these mechanisms have been relatively complex, prone to failure and in many cases, relatively expensive. The locking mechanism should be fail-safe such that in the event of electrical or other power failure, the device will remain locked despite such power failure.

Accordingly, it is an object of this invention to obviate any of the disadvantages of the prior art of safety locking mechanisms.

Another object of this invention is to provide an improved safety locking mechanism which is of relatively low cost and simple in construction.

BRIEF DESCRIPTION OF THE INVENTION

In a preferred embodiment of this invention, a safety locking mechanism for a closure assembly on a compartment housing an operation to be protected against, includes a latch having latched and unlatched positions and a mechanical linkage positionable to lock and unlock the latch when the latch is in the latched position.

The latch is locked and unlocked by the use of a driven means connected to position the linkage, a prime mover for positioning the driven means in a first sense to a first position to unlock the latch, spring means for urging the driven means in a second sense opposite the first sense to a second position to lock the latch, and first sensing means responsive to the driven means being in said second position for enabling said operation.

In a particularly preferred embodiment, the spring means positions the driven means in the second sense to a third position beyond the second position if the latch is not latched. The first sensing means is responsive to the first and third positions of said driven means for disabling said operation. The first sensing means may be a microswitch having a switch actuating arm which contacts a detent located in the driven means when the latch is in the second position. Preferably the mechanical linkage is flexible such that the driven means may be located at a location remote from the latch itself. A second sensing means is responsive to the prime mover's position and hence to the position of the driven means and linkage for actuating the prime mover to lock the latch.

BRIEF DESCRIPTION OF THE DRAWINGS

Further advantages and features of this invention will become apparent upon consideration of the following description wherein.

DETAILED DESCRIPTION OF THE PREFERRED EMBODIMENTS

Figures 1, 2, 3:
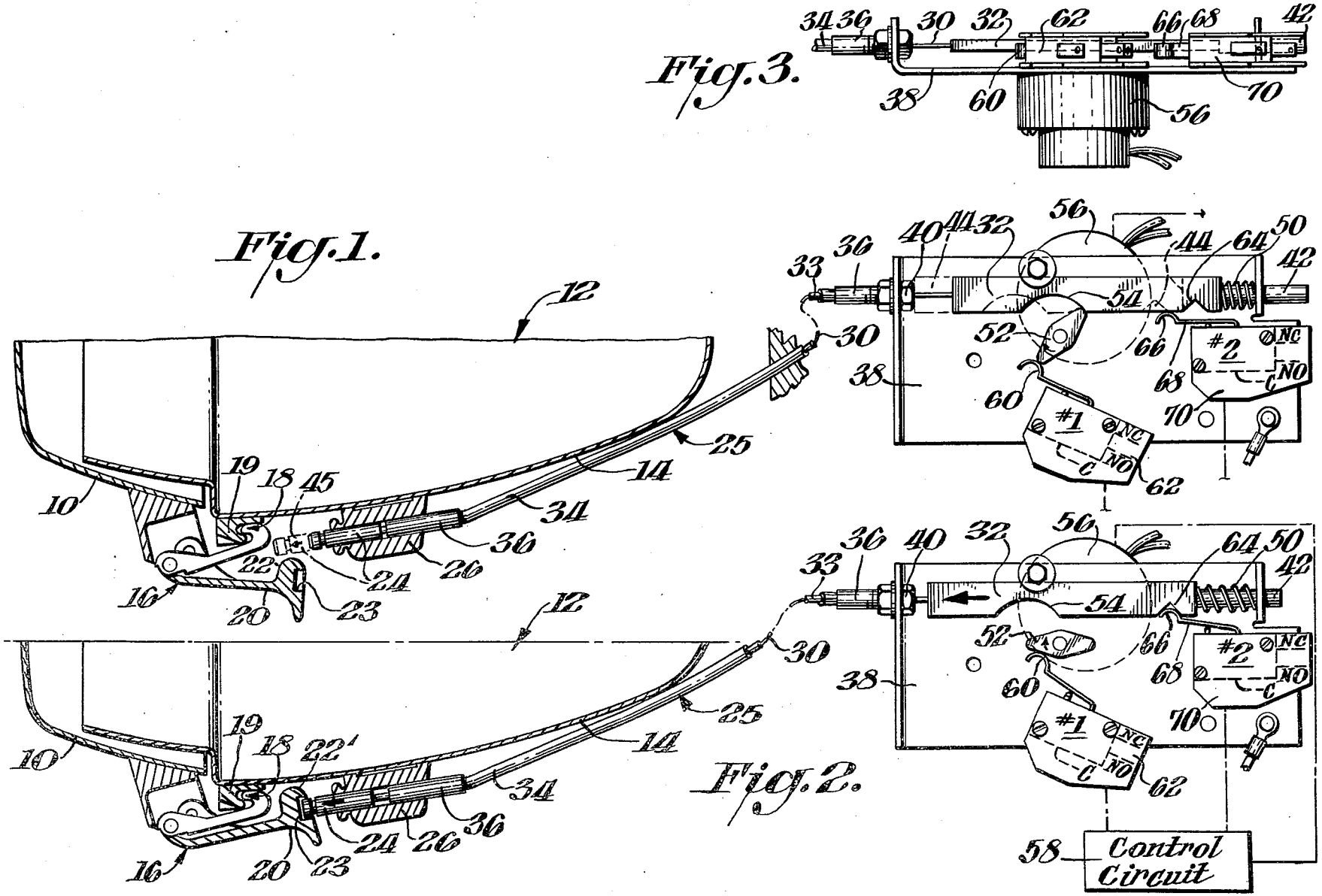
FIG. 1 is a partial elevation view of the mechanical portions of a safety locking mechanism constructed in accordance with the preferred embodiment of this invention, particularly depicting two operating positions of the mechanism.
FIG. 2 is a partial elevation view of the mechanism illustrated in FIG. 1 with the latch in a third or locked position.
FIG. 3 is a side view of a portion of the locking mechanism illustrated in FIG. 1.

There may be seen in FIG. 1 a fragmentary cross-sectional showing of a safety locking mechanism constructed in accordance with a preferred embodiment of this invention. For purposes of illustration only, the locking mechanism is shown as being used to secure the lid or closure assembly 10 of a typical centrifuge 12. The centrifuge 12 has a rotor compartment 14 which is closed at the upper portion (left hand portion in the drawing) thereof and access thereto may be had by lifting the lid or closure assembly 10. The closure assembly 10 and rotor compartment 14 provide a protective housing for a rotor (not shown) which is adapted to spin at high speeds.

The closure assembly 10 has a latch assembly 16 which is adapted to secure by an inner latch 18 adapted to engage a suitable fixed, mating latch or catch 19 on the rotor compartment 14. The lower portion of the centrifuge 12 is secured to the closure assembly 10 in such a manner as to deny access to the interior of the rotor compartment. The latch assembly 16 also includes a locking arm 20 (shown in cross-section) which is pivotable between the unlocked position 22 illustrated in FIG. 1 and a locked position 22' illustrated in FIG. 2. The locking arm 20 operates to hold or lock the latch 18–19 in a latched position and cannot be operated if the latches 18–19 are not in a locked position. The extreme end portion of the locking arm 20 includes a bore 23 which is adapted to receive therein a plunger 24 which, by way of example, is illustrated as being solid and cylindrical in shape. Other configurations may of course be used as is desired so long as the plunger 24 is permitted to slide into or engage the locking arm 20 to lock the same in the locked position 22' and thereby prevent the latch 18–19 from being released.

The plunger is part of a mechanical linkage 25 and is adapted to slide within a guide member 26. The plunger 24 is linked by means of a flexible rod or linkage 30 to a driven means such as a cam follower 32.

The flexible linkage 30 is adapted to slide within a flexible casing 33 which in turn is enclosed within a jacket 34. Each end of the jacket 34 is secured by respective end pieces 36 which are secured to the guide 26 and a base bracket 38, respectively, by any suitable means such as by a friction fit in the guide member 26 or by nuts 40 with respect to the base bracket 38. This permits the locking arm 20 and the cam follower 32 to be positioned from locations remote from the control unit housed in bracket 38. Alternatively, the two may be connected by a rigid linkage and pivotally located close together such as on the side of the centrifuge 12.

The cam follower 32, as may be seen in FIGS. 1, 2 and 3, has one end secured as by welding, brazing and the like, to the flexible linkage 30. The other end of the cam follower is of reduced dimensions such that it can slide through a slot (not shown) in the base bracket 38. The reduced dimension portion 42 forms a core for supporting a compression spring 50 or other passive device capable of returning to an initial position. The spring 50 urges the cam follower and hence the linkage 30 toward the locking arm (to the left in the drawing). In this manner the cam follower 32 urges the plunger into engagement with the locking arm 20 thereby locking the arm if it is indeed in a lockable position (FIG. 2). The bore 23 of the locking arm accommodates this movement of the plunger and hence of the driven means to the position particularly depicted in FIG. 2 by the solid lines. In the event the locking arm is in this unlocked position, denoted by the solid lines in FIG. 1, the movement of the plunger is not inhibited and it can move forward to a greater extent than is otherwise permitted such that the cam follower 32 attains the position depicted by the dotted lines 44 and the plunger 24 attains the position depicted by the dotted lines 45.

In accordance with the invention, a prime mover depicted here as a drive cam 52 having a generally oval-shaped cam surface, is adapted to coact with an arcuate surface 54 formed in the cam follower such that clockwise rotation of the drive cam 52 periodically moves or urges the cam follower in a sense that compresses the spring 50 (to the right in the drawing). The drive cam 52 is activated by a motor 56 controlled by suitable control circuit 58 shown in particular detail in FIG. 4 and will be described hereinafter. The drive cam 52 also acts against the switch arm 60 of a first microswitch 62 which forms part of the control circuit 58. The cam follower 32 also includes a detent 64 which is adapted to engage the "U" shaped contact 66 on the end of a switch arm 68 of a second microswitch 70. This microswitch also forms part of the control circuit 58.

Figure 4:
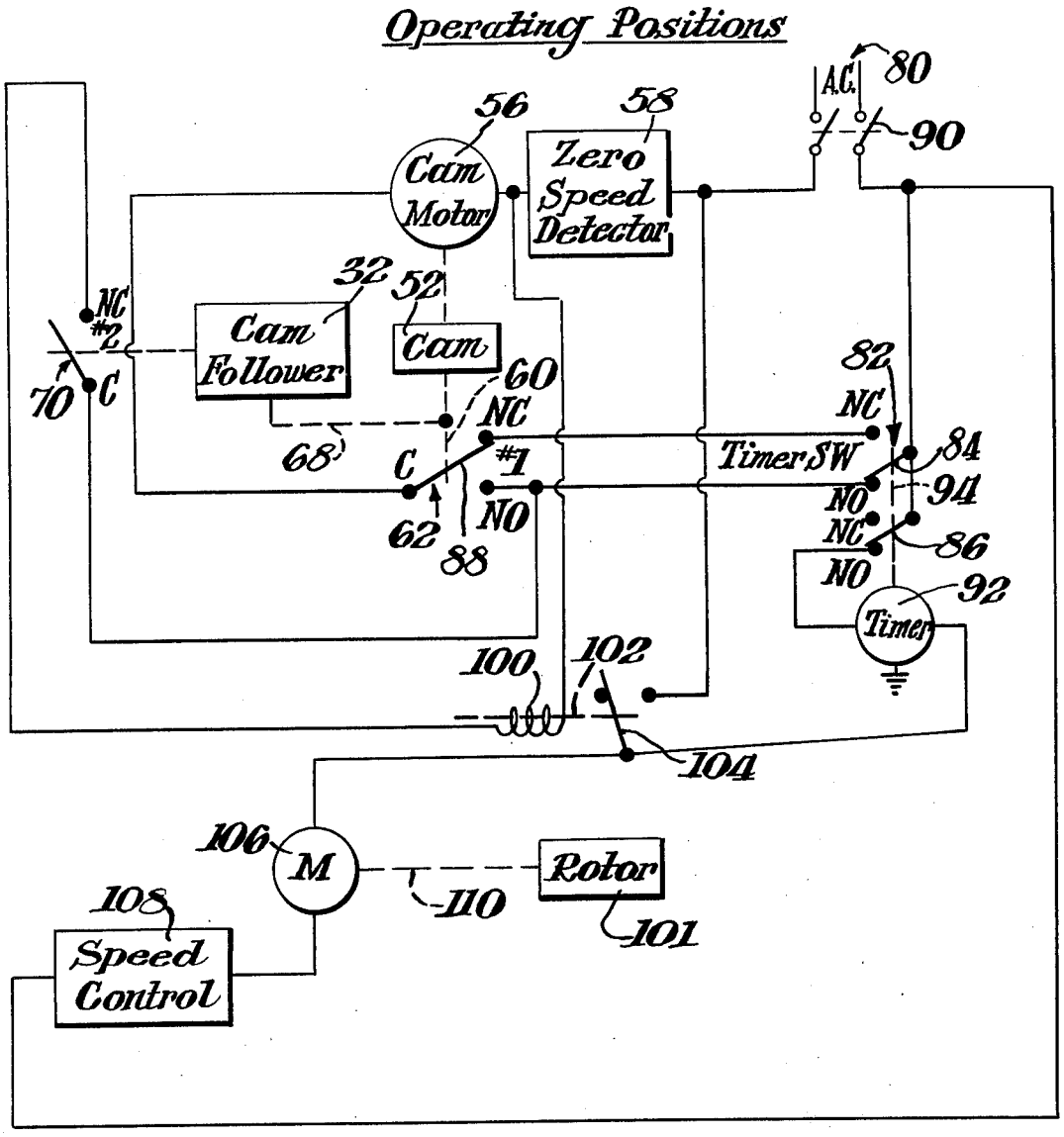
FIG. 4 is a partial schematic illustration of electrical control circuitry that may be used for the mechanism depicted in FIGS. 1 and 2.

The details of the control circuit 58 are shown in FIG. 4 in which an electrical power source 80, such as line voltage, has one terminal connected through a switch 90 to the common terminal of a double pole, double throw switch which will be designated as timer switch 82. This switch 82 has two pairs of contacts designated NO and NC, respectively, and two switch arms 84 and 86. Each of the switch arms 84 and 86 are adapted to contact the common terminal of the respective switches to either a normally closed (NC) or a normally open (NO) terminal. The NC and NO terminals associated with the upper (in the drawing) switch arm 84 are coupled to respective NC and NO terminals of the first switch 62. The first switch 62 has a switch arm 88 whose common terminal is connected to one input of the cam motor 56.

The other input of the cam motor is connected to a zero speed detector 58 of any conventional type. One type which can be used is a conventional magnetic detector which permits the passage of a signal when a zero or some predetermined level of speed is achieved. This speed detector is associated with the rotor and passes a signal to the detector 58 when the rotor reaches such predetermined low or zero speed. The other side of the zero speed detector 58 is connected through the switch 90 to the second terminal of the supply 80 and through a relay driven switch 104 to one input of a timer motor 92 and to a motor 106. The motor 106 drives the rotor 101 through a suitable linkage 110. The other side of the motor 106 is connected to a conventional speed control circuit 108, which does not form part of this invention, and which is returned to the first side of the supply 80. The timer motor 92, acting through a suitable linkage depicted by the dashed line 94, drives both of the switch arms 84 and 86 in sequence with the operation of the switch arm 86 lagging that of the switch arm 84. Actually separate linkages from the timer 92 to the switches are preferred to effect this leg. The other side of the timer motor is connected to the NO terminal associated with the lower switch arm 86 (in the drawing). The point between the cam motor 56 and the zero speed detector 58 is connected through a relay coil 100 which actuates the switch 104 through a linkage 102. The NO contact of the first switch 88 is connected through a switch 70 to the relay coil 100 to complete the loop. The switch 70 is actuated by the cam follower 32. The common terminal of this second switch 70 is connected to the NO terminal of the first switch 62.

Utilizing the system of this invention which incorporates a safety latching mechanism, the closure assembly 10 is closed, the latch 18 engaged, and the locking arm 20 moved to the latching position 22'. Next, the timer 92, which actuates the switch arms 84 and 86, is set, moving first the switch arm 84 and then the switch arm 86 from the NC contact to the NO contact. During the off time of the centrifuge, as will become apparent from this description, the cam follower 32 was in the position illustrated in FIG. 1 with the drive cam 52 having moved the cam follower 32 in such a sense as to compress the spring 50 and withdraw the plunger 24 from the locking arm 20 so that the centrifuge lid could be raised. Under these conditions the first switch 62 has its switch arm depressed (FIG. 1) such that the switch arm 88 is in contact with the NO terminal. At the same time the arm of the second switch 70 is depressed (FIG. 1) such that the switch is open. The start relay 100 for the centrifuge motor 106 is open and the cam motor 56 remains unenergized.

Under these initial conditions the cam motor 56 is energized by the movement of the timer switch arm 84 to the NO position to complete a circuit through the switch arm 88 of the first switch which is in the NO position. The drive cam therefore rotates in a clockwise sense to release the driven means 32 such that it moves rapidly, i.e., snaps, under the influence of the spring 50, to move the plunger into engagement with the locking arm 20 (FIG. 2). At the same time the first switch arm 60 is released such that the arm 88 (FIG. 4) moves to the NC contact depicted in FIG. 4 and the cam motor 56 is deenergized. This leaves the cam, roughly in a horizontal position in the drawing, out of contact with both the first switch 62 and the cam follower 32.

If the centrifuge closure is properly engaged, the movement of the plunger will be limited such that the cam follower detent 64 receives the U-shaped end of the switch arm of the second switch 70 permitting this switch to move to the NC position thereby actuating the start relay 100 and energizing the centrifuge motor 106 causing the rotor 101 to spin. With the plunger in position, the centrifuge is now latched and locked safely and securely and cannot be opened until the centrifuge is again stopped.

If on the other hand, the closure assembly was not closed properly such that the latch 18 was improperly engaged and the latch assembly 16 is not closed as seen in FIG. 1, the plunger 24 is permitted to move a greater distance as shown at 45, than if it were impeded by the locking arm 20. Under these conditions the cam follower 32 moves to a greater extent with the contact 66 past the detent 64 to the position depicted by the dotted lines 44. This maintains the second switch 70 open such that the centrifuge motor start relay cannot be energized and the centrifuge cannot start. Improper operation is thereby avoided.

The operator must now open the door and restart the sequence. This includes resetting the timer switch such that its switch arms are at the NC terminals. Since the switch arm 88 of the first switch 62 is at the NC terminal (the cam being out of contact with the switch) the cam motor again restarts and by rotating in a clockwise direction, retracts the cam follower 32 to the normal retracted position illustrated in FIG. 1. Rotation of the drive cam 52 continues until the first switch arm 88 is depressed to the NO position opening the circuit to the cam motor 56. During this sequence the rotor cannot start even for a brief time. When the detent 64 is aligned with the switch arm of the second switch 70, indicating proper locking, the normal starting sequence previously described, can be repeated.

After a run the timer 92 moves its switch arms back to the NC contacts, thereby de-energizing the start relay 100 and de-energizing the rotor motor 106. As soon as the rotor motor 100 has achieved substantially zero speed as sensed by the zero speed detector 58, the cam motor 56 is energized through the NC contact of the first switch 88 and the NC contact of the timer switch 82 causing the cam to rotate, retracting the driven means and plunger and unlocking the locking arm 20. The second switch is opened and the first switch arm 88 is returned to the NO terminal, once the cam follower is retracted, to await another cycle.

While the plunger has been described as locking a latch it is to be understood that it may provide, if desired, the sole latching mechanism and directly engage the closure assembly.

The system thus described is a relatively simple system in which a centrifugation or other operation taking place within an enclosure can be operated only if a door is closed and locked. Once locked, the door cannot be opened until the operation is terminated. The locking mechanism is located at a point remote from the control point and is fail-safe in the sense that, being actuated by a passive device, such as a spring, utilizing stored energy, it may be locked and will remain locked even in the event of loss of power. Power is needed only to unlock the apparatus. The apparatus is relatively simple and requires relatively few component parts.

I claim:

1. A safety locking mechanism for a closure assembly on a compartment housing a centrifuge rotor to be protected against, said rotor having a driving motor, said mechanism having a mechanical linkage positionable to lock and unlock said closure assembly when said assembly is in a lockable position comprising, in combination, driven means connected to position said mechanical linkage to lock and unlock said closure assembly, prime mover means for driving said driven means and hence said mechanical linkage in a first sense to a first position when said rotor is stopped;

spring means for driving said driven means in a second sense opposite said first sense to a second position to lock said closure assembly when said assembly is in said lockable position, and first sensing means electrically coupled to said motor and responsive to said driven means being in said second position for enabling said motor.

2. A safety locking mechanism according to claim 1 wherein said spring means drives said driven means in said second sense to a third position beyond said second position when said closure assembly is not is said lockable position, said first sensing means being responsive to said first and third positions of said driven means for deenergizing said motor.

3. A safety locking mechanism according to claim 2 wherein said first sensing means is a microswitch having a switch actuating arm and said driven means has a detent located to release said switch actuating arm when said driven means is in said second position, thereby to enable said motor.

4. A safety locking mechanism according to claim 3 wherein the mechanical linkage is flexible.

5. A safety locking mechanism according to claim 3 which also includes a second sensing means electrically coupled to said prime mover and responsive to said driven means and said linkage being in said second position, for enabling said prime mover to drive said driven means to said first position.

6. A safety locking mechanism according to claim 5 which includes a start-stop switch, wherein said second sensing means is responsive to said switch in a start position for releasing said driven means to the action of said spring means.

7. A safety locking mechanism according to claim 6 wherein said second sensing means is responsive to said closure assembly being locked and to said switch being in a stop position for actuating said prime mover to withdraw said mechanical linkage and unlock said closure assembly.

8. A safety locking mechanism according to claim 7 wherein said start-stop switch is time controlled.

9. A safety locking mechanism according to claim 7 which also includes a rotor speed detector, said second sensing means also being responsive to a predetermined speed condition of said rotor before enabling said prime moover to unlock said closure assembly.

10. A safety locking mechanism according to claim 9 wherein the mechanical linkage is flexible.

11. A safety locking mechanism according to claim 1 wherein said first sensing means is a microswitch having a switch actuating arm, said driven means has a detent located to release said switch actuating arm when said driven means is in said second position, thereby to enable said centrifuge.

12. A safety locking mechanism according to claim 1 which also includes a second sensing means responsive to said prime mover position, and hence the positions of said driven means and said mechanical linkage, for actuating said prime mover.

13. A safety locking mechanism according to claim 2 which also includes a second sensing means responsive to said prime mover position, and hence the positions of said driven means and said mechanical linkage, for actuating said prime mover.

* * * * *